US007942090B1

(12) United States Patent
Hoffman

(10) Patent No.: US 7,942,090 B1
(45) Date of Patent: May 17, 2011

(54) ENHANCED OPERATING LIFE BLANK FIRE ATTACHMENT FOR GAS-OPERATED WEAPONS

(75) Inventor: Brian Hoffman, Bangor, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 100 days.

(21) Appl. No.: 12/425,463

(22) Filed: May 7, 2009

Related U.S. Application Data

(63) Continuation-in-part of application No. 11/306,647, filed on Jan. 5, 2006, now abandoned.

(60) Provisional application No. 60/593,397, filed on Jan. 11, 2005, provisional application No. 60/595,521, filed on Jul. 12, 2005.

(51) Int. Cl.
*F41A 21/00* (2006.01)

(52) U.S. Cl. ..... 89/29; 89/14.5; 42/76.01; 42/96

(58) Field of Classification Search ..... 89/29, 14.05, 89/14.5; 42/76.01, 96
See application file for complete search history.

(56) References Cited

U.S. PATENT DOCUMENTS 2,356,538 A * 8/1944 Schmeisser ..... 42/106
3,687,000 A * 8/1972 Csizmar et al. ..... 89/14.5

* cited by examiner

*Primary Examiner* — Michelle Clement
(74) *Attorney, Agent, or Firm* — Henry S. Goldfine

(57) ABSTRACT

An blank firing attachment, with enhanced operating life, for use with gas-operated weapons; wherein, a tungsten carbide stem extending from the attachment is inserted into the bore of the weapon's barrel, the stem having a cross-sectional area less than the cross-sectional area of the bore, to provide back-pressure within the barrel to properly cycle the weapon.

2 Claims, 6 Drawing Sheets

ENHANCED OPERATING LIFE BLANK FIRE ATTACHMENT FOR GAS-OPERATED WEAPONS

CROSS-REFERENCE TO RELATED APPLICATIONS

This application is a continuation-in-part of copending application Ser. No. 11/306,647, filed Jan. 5, 2006, which copending application claims priority from U.S. provisional patent applications 60/593,397 filed on Jan. 11, 2005, and, 60/595,521 filed on Jul. 12, 2005; the contents of Ser. Nos. 11/306,647, 60/593,397 and 60/595,521 are incorporated herein by reference.

STATEMENT OF GOVERNMENT INTEREST

The inventions described herein may be manufactured, used and licensed by or for the U.S. Government for U.S. Government purposes.

FIELD OF THE INVENTION

The invention relates in general to firearms and in particular to an adaptor which permits gas-operated or gas-assisted firearms to properly operate when firing blank ammunition.

BACKGROUND OF THE INVENTION

When firing a gas-operated or gas-assisted firearm, the backpressure generated by the propellant gases as the bullet traverses the bore is used to automatically cycle the operating group of the weapon. When firing low impulse ammunition such as blank cartridges, it is often necessary to use a Blank Firing Attachment (BFA) to generate sufficient backpressure to cycle the weapon. The BFA typically attaches to the muzzle end of the weapon's barrel.

The prior art BFA's used by the United States Army on gas-operated rifles and small and medium caliber machine guns utilize a cylindrical threaded stem and a housing that attaches to the weapon's muzzle compensator or flash suppressor. The threaded stem traverses axially during installation until the lower portion of the stem contacts either an internal feature of the muzzle device, a crush that sits between the muzzle device and barrel crown, or the barrel crown itself, at which point the bore is sealed. To prevent overpressure in the bore during firing, excess gas is released into the atmosphere through a bleed hole leading from an axial cavity in the BFA stem. Despite its use on the M4/M16 rifles, M249 Squad Automatic Weapon, and M240 Machine Gun, this style BFA does have several shortcomings.

Until now, the BFA design used by the U.S. Army is the subject matter of U.S. Pat. No. 5,325,758, entitled "Blank Firing Attachment" issued on Jul. 5, 1994 to Compton et al. (hereinafter "Compton"). Compton recognized that the threaded stem, exposed to corrosive gases when firing blanks, and stated that it must be manufactured of a material to withstand such gases, specifically, specifying ASTM A331 Grade 4140 cold finished steel.

Prior U.S. Pat. No. 3,766,822, entitled Blank Firing Adaptor for Gas Operated Firearms, issued Oct. 23, 1973 to Sophinos, disclosed an adaptor substantively identical in overall design to that disclosed herein; which uses a plug in place of the threaded stem disclosed by Compton. Sophinos, like Compton, merely states that the plug should be formed of a suitable heat resistant, rugged, fragible material such as steel. Such steel threaded stems or plugs, used by Compton, Sophinos, and the prior art, quickly erodes due to the corrosive gases after firing only a finite number of such rounds, often, as few as 200 rounds. This erosion of the threaded stem, or plug, allows excessive escape of propellant gases generated by the firing of the blank cartridge and therefore there is insufficient back-pressure to automatically cycle the operating group of the gas-operated weapon. Therefore, there is a need in the art for a BFA which will allow firing at least an order of magnitude more rounds, before failing.

SUMMARY OF THE INVENTION

The present invention is a blank firing attachment for a gas-operated weapon having a barrel, the barrel having a bore with a cross-sectional area, the blank firing attachment comprising a housing having first and second ends; a stem supported at the first end of the housing and extending along a longitudinal axis of the housing, the stem for insertion into the bore of the barrel, the stem having a cross-sectional area less than the cross-sectional area of the bore; and means for attaching the housing to the weapon; wherein, upon firing a blank cartridge in the weapon, a difference between the cross-sectional area of the bore and the cross-sectional area of the stem is an area small enough to generate sufficient backpressure in the bore as to operate the weapon and large enough to bleed excess gas from the system as to prevent an overpressure condition in the bore. With the stem being manufactured of tungsten carbide (otherwise known as carbide, or cemented carbide), it has surprisingly been found that over 10,000 blank rounds can be fired before the stem erodes to the point that there was insufficient back-pressure for the gas operated weapon to cycle properly. Further, tungsten carbide lends itself to such an application, as it is economical, readily available, and commercially produced in stock sizes comparable to the various stem diameters required for various weapons.

To minimize erosion, it is preferred that the stem be manufactured of tungsten carbide have a uniform microstructure, with a maximum grain size of less than 1 micron; a minimum tungsten carbide content of about 80%; a minimum cobalt content of about 10%, and a minimum hardness on the Rockwell A scale of about 91. A more preferred tungsten carbide conforms to the International Organization for Standardizations (ISO) standard 513, K20 to K30 tungsten carbides, which require, tungsten carbide content of about 84 to about 90 mass %; cobalt content of 10 to about 16 mass %; a grain size of about 0.6 to about 0.8 microns (i.e. ultra fine to micro fine grade). Further, K20 to K30 tungsten carbide, has a Ra hardness of about 91.4 to about 91.8; transverse rupture strength of about 4 to about 4.3 GPa; fracture toughness of about 7.5 to about 8.7 MPa-$m^{1/2}$ and density of about 13.7 to about 14.5 g/$cm^3$.

The barrel end of the weapon includes a circumferential groove formed in an exterior surface thereof. The means for attaching the housing to the weapon comprises a flange at the second end of the housing, guides formed on the flange and a retainer that reciprocates in the guides and fits in the circumferential groove in the barrel end of the weapon.

If the barrel end of the weapon comprises a barrel, the circumferential groove is formed in the barrel. If the barrel end of the weapon comprises a muzzle device, the circumferential groove is formed in the muzzle device.

Another aspect of the invention is an apparatus comprising a gas-operated weapon having a barrel, the barrel having a bore with a cross-sectional area; and a blank firing attachment attached to the weapon, the blank firing attachment comprising a housing having first and second ends; a stem supported at the first end of the housing and extending along a longitudinal axis of the housing, a part of the stem being inserted into the bore of the barrel, the stem having a cross-sectional area less than the cross-sectional area of the bore; and means for attaching the housing to the weapon; wherein, upon firing a blank cartridge in the weapon, a difference between the cross-sectional area of the bore and the cross-sectional area of the stem is an area small enough to generate sufficient backpressure in the bore as to operate the weapon and large enough to bleed excess gas from the system as to prevent an overpressure condition in the bore.

The barrel end of the weapon includes a circumferential groove formed in an exterior surface thereof, the means for attaching the housing to the weapon comprising a flange at the second end of the housing, guides formed on the flange and a retainer that reciprocates in the guides and fits in the circumferential groove in the barrel end of the weapon. If the barrel end of the weapon comprises the barrel, the circumferential groove is formed in the barrel. If the barrel end of the weapon comprises a muzzle device, the circumferential groove is formed in the muzzle device.

Yet another aspect of the invention is a muzzle device for a weapon having a barrel end that includes a circumferential groove formed in an exterior surface thereof, the muzzle device comprising a housing; a flange attached to the housing; guides formed on the flange; and a retainer that reciprocates in the guides and fits in the circumferential groove in the barrel end of the weapon.

If the barrel end of the weapon comprises a barrel, the circumferential groove is formed in the barrel. If the barrel end of the weapon comprises a second muzzle device, the circumferential groove is formed in the second muzzle device.

The retainer including a pair of spaced apart legs that fit in the guides, the pair of spaced apart legs also fitting in the circumferential groove in the barrel end of the weapon. One of the guides includes a pin fixed therein and a corresponding one of the pair of legs includes a slot of reduced thickness extending partially along its length, the pin engaging the slot to allow the retainer to reciprocate in the guides and the pin butting against an end of the slot to maintain the retainer at least partially in the guides.

The muzzle device further comprises a flat spring attached to the flange on a side opposite the guides, a stop that extends through the flange and has a head against which the flat spring bears and further wherein, when the pair of legs of the retainer fully engage the circumferential groove in the barrel end of the weapon, the stop abuts the retainer to prevent the retainer from disengaging from the circumferential groove.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not to scale, like or corresponding parts are denoted by like or corresponding reference numerals.

DETAILED DESCRIPTION OF THE PREFERRED EMBODIMENTS

The present invention includes a BFA for gas-operated and gas-assisted weapons. The BFA attaches to the muzzle end of a gun barrel and generates sufficient backpressure to automatically cycle the operating group of the weapon when firing blank ammunition. The BFA may be used with all semi and fully-automatic gas-operated and gas-assisted weapons. To properly cycle the weapon action, a predetermined optimized clearance between the outer diameter of the BFA stem and the inner diameter of the barrel bore is essential. This designed clearance must be maintained with as little variability as possible to facilitate the consistent operational pressure levels that are required for proper weapon powering.

Figure 1A:
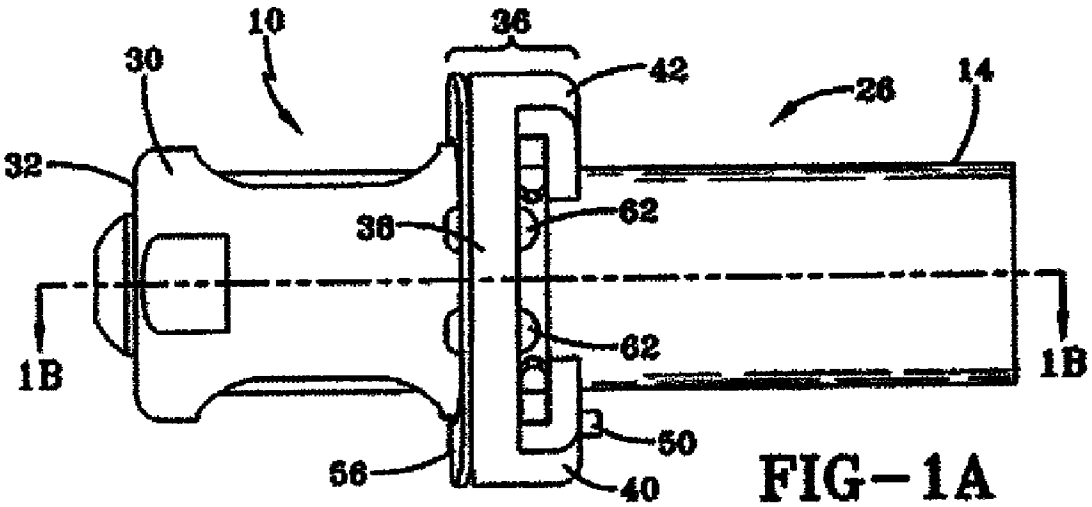
FIG. 1A is a side view of one embodiment of a BFA in accordance with the invention, attached to a flash suppressor that is fixed to a barrel.
Figure 1B:
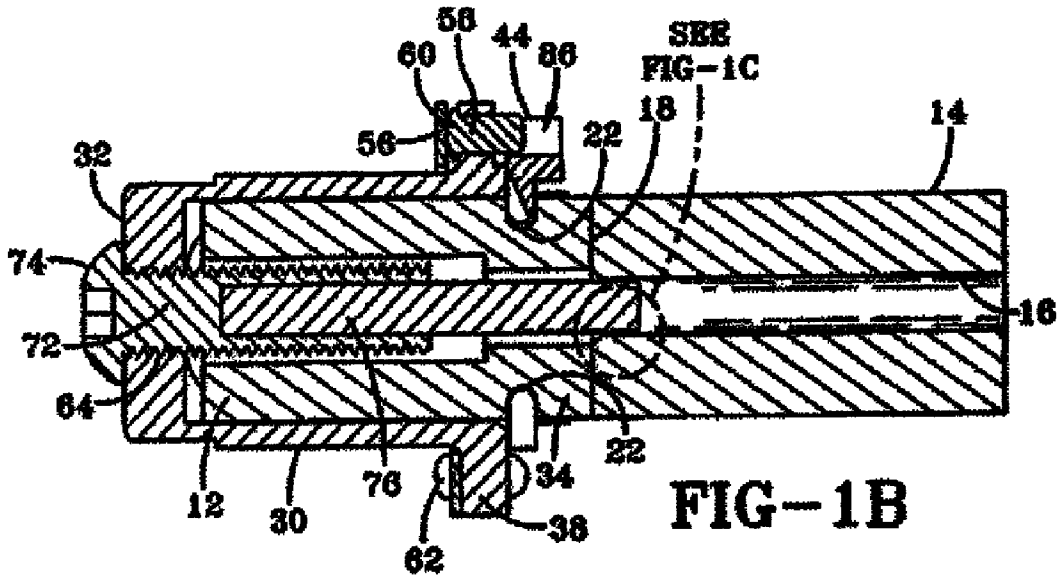
FIG. 1B is a sectional view taken along the line 1B-1B of FIG. 1A.
Figure 1:
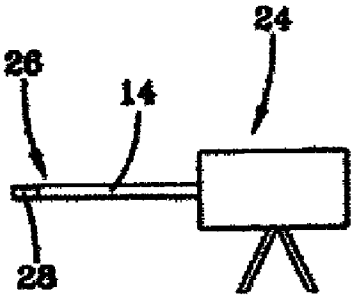
FIG—1 PRIOR ART
FIG. 1 is a schematic view of a gas operated weapon.

FIG. 1 is a schematic view of a gas-operated or gas-assisted weapon 24 having a barrel end 26. The barrel end 26 may comprise a barrel 14 only, or the barrel end 26 may comprise one of many known types of muzzle devices 28 that are fixed to barrel 14. The barrel end 26 of the weapon 24 may include a circumferential groove 22 (FIG. 1B) formed in an exterior surface thereof. If the barrel end 26 comprises the barrel 14 only, then the circumferential groove may be formed in the barrel 14. If the barrel end 26 comprises a muzzle device, then the circumferential groove may be formed in the muzzle device, as shown in FIG. 1B.

Figure 1C:
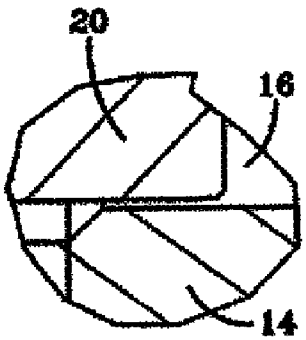
FIG. 1C is an enlarged view of a portion of FIG. 1B.

FIG. 1A is side view of one embodiment of a BFA 10 in accordance with the invention. FIG. 1B is a sectional view taken along the line 1B-1B of FIG. 1A. FIG. 1C is an enlarged view of a portion of FIG. 1B. The BFA 10 is attached to the barrel end 26 of the gas-operated or gas-assisted weapon 24. As seen in FIG. 1B, the barrel end 26 comprises a muzzle device in the form of a flash suppressor or muzzle compensator 28 attached to barrel 14. Barrel 14 typically has a cylindrical bore 16 having a cross-sectional area dependent on the inner radial dimensions of the bore 16. The end of barrel 14 is the barrel crown 18.

Figure 2B:
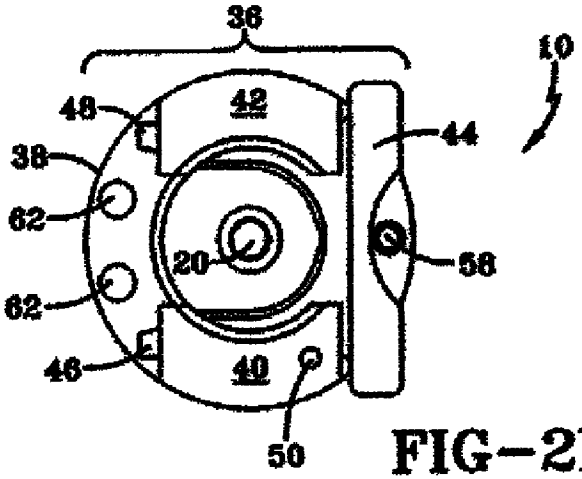
FIG. 2B is a front end view of FIG. 2A.
Figure 2D:
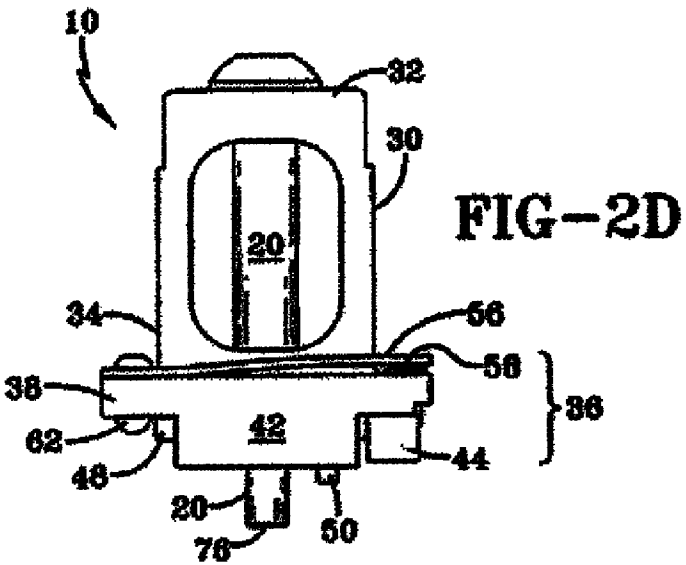
FIG. 2D is a side view of FIG. 2A.
Figure 2A:
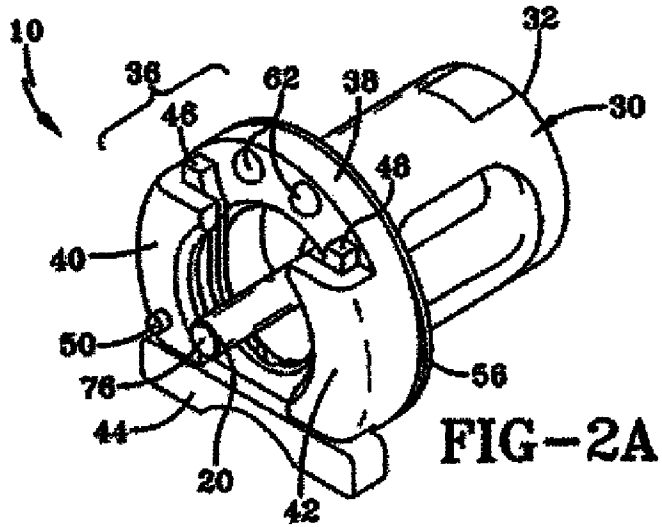
FIG. 2A is a perspective view of the BFA of FIG. 1A.
Figure 2C:
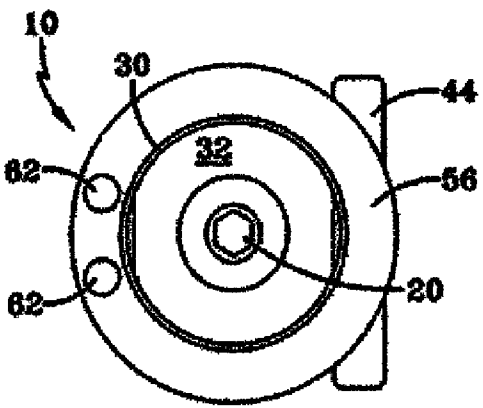
FIG. 2C is a rear end view of FIG. 2A.

FIG. 2A is a perspective view of the BFA 10 of FIG. 1A. FIG. 2B is a front end view of FIG. 2A. FIG. 2C is a rear end view of FIG. 2A. FIG. 2D is a side view of FIG. 2A. BFA 10 includes a housing 30 having first and second ends 32, 34. A stem 20 is supported at the first end 32 of the housing 30 and extends along a longitudinal axis of the housing 30. The stem 20 is fastened to first end 32 of housing 30 through the use of threads 64 (FIG. 1B), although other ways of fastening may be used, such as a retaining ring, pin, weldment, or other similar connection.

Part of the stem 20 is inserted into the bore 16 of the barrel 14, as best seen in FIGS. 1B and 1C. The part of the stem 20 that is inserted in the bore has a cross-sectional area less than the cross-sectional area of the bore 16. The BFA 10 includes a means 36 for attaching the housing 30 to the weapon 24. The inventive quick attach/release mechanism comprises the means 36. The means 36 for attaching the housing 30 to the weapon 24 comprises a flange 38 at the second end 34 of the housing 30, guides 40, 42 formed on the flange 38 and a retainer 44 that reciprocates in the guides 40, 42.

Figure 5C:
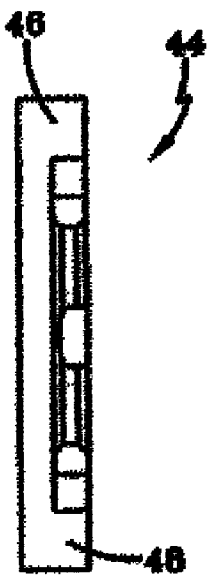
FIG. 5C is a side view of the retainer of FIG. 5A.
Figure 5B:
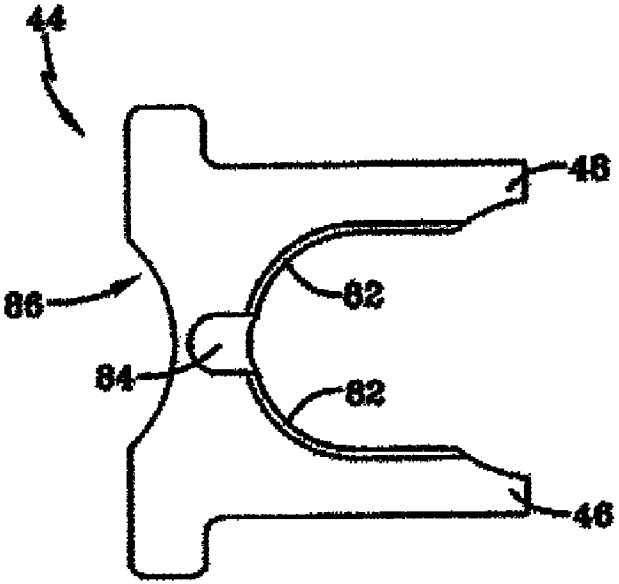
FIG. 5B is a back view of the retainer of FIG. 5A.
Figure 5E:
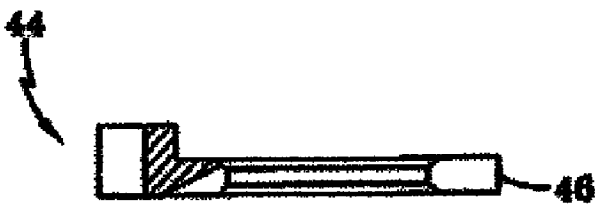
FIG. 5E is a sectional view taken along the line 5E-5E of FIG. 5A.
Figure 5A:
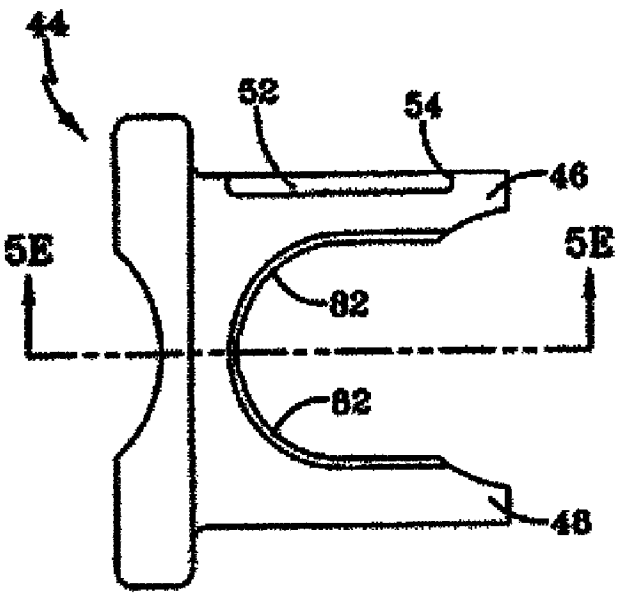
FIG. 5A is a front view of a retainer.
Figure 5D:
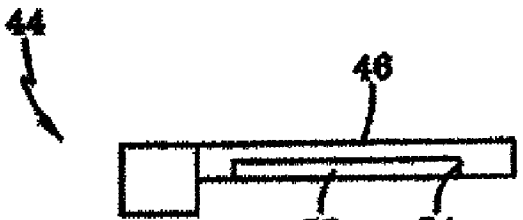
FIG. 5D is a top view of the retainer of FIG. 5A.

FIG. 5A is a front view of a retainer 44. FIG. 5B is a back view of the retainer of FIG. 5A. FIG. 5C is a side view of the retainer of FIG. 5A. FIG. 5D is a top view of the retainer of FIG. 5A. FIG. 5E is a sectional view taken along the line 5E-5E of FIG. 5A. Retainer 44 fits in the circumferential groove 22 in the barrel end 26 of the weapon. Retainer 44 includes a pair of spaced apart legs 46, 48 that fit in the guides 40, 42. The pair of spaced apart legs 46, 48 slide in the circumferential groove 22 in the barrel end 26 of the weapon. Both sides of legs 46, 48 include angled portions 82 that assist the movement of the legs in the circumferential groove 22.

Figure 3B:
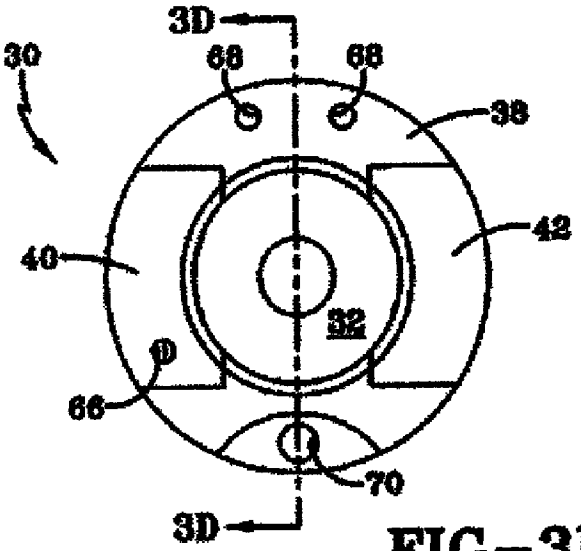
FIG. 3B is a front end view of FIG. 3A.
Figure 3D:
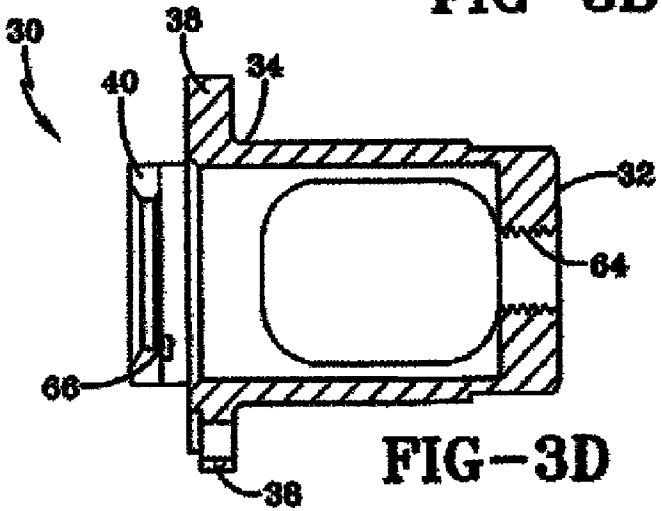
FIG. 3D is a sectional view taken along the line 3D-3D of FIG. 3B.
Figure 3A:
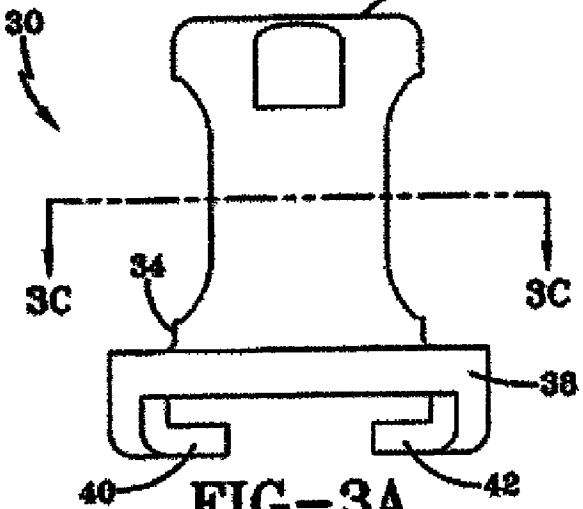
FIG. 3A is a side view of the housing of the BFA of FIG. 2A.

As shown in FIGS. 2A and 2B, guide 40 includes a pin 50 fixed therein. The corresponding leg 46 of the retainer 44 includes a slot 52 (FIG. 5A) of reduced thickness that extends partially along its length. Pin 50 engages the slot 52 during reciprocation of the retainer 44 in the guides 40, 42. Pin 50 butts against an end 54 of the slot 52 to capture the retainer 44 at least partially in the guides 40, 42. FIGS. 3B and 3D show the opening 66 in guide 40 for pin 50.

Figure 6B:
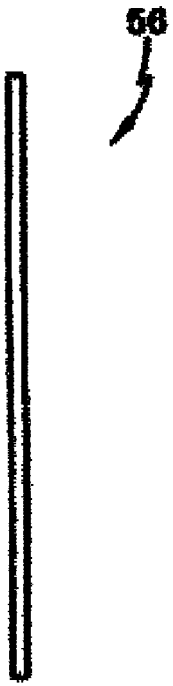
FIG. 6B is a side view of FIG. 6A.
Figure 6A:
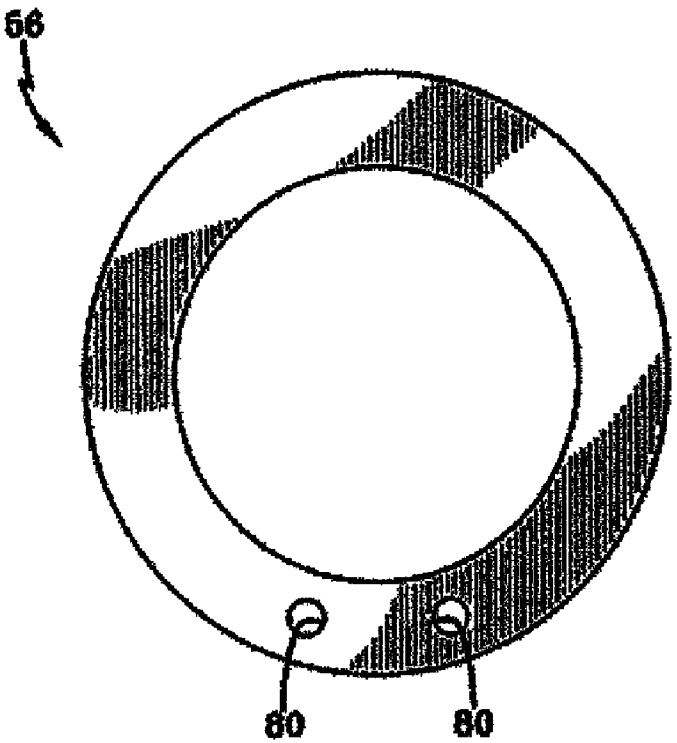
FIG. 6A is a front view of a spring.

As shown in FIGS. 2A-D, the means 36 for attaching the housing 30 further comprises a flat spring 56 attached to the flange 38 on a side of the flange opposite the guides 40, 42. FIG. 6A is a front view of a spring 56. FIG. 6B is a side view of FIG. 6A. As seen in FIG. 6A, the spring 56 includes a pair of openings 80 for rivets 62 that are used to attach spring 56 to housing 30. A stop 58 (FIGS. 2B and 2D) extends through the flange 38 and has a head 60 (FIG. 1B) against which the flat spring 56 bears.

Figure 3C:
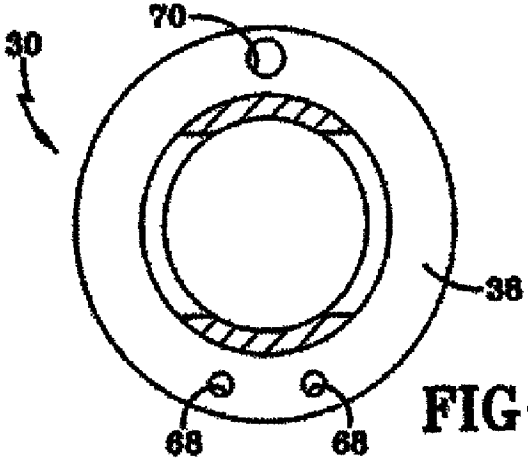
FIG. 3C is a sectional view taken along the line 3C-3C of FIG. 3A.

As the retainer 44 is pushed into the circumferential groove 22, the stop 58 rides up ramp 84 (FIG. 5B) and is pushed through flange 38 outward against spring 56. When the pair of legs 46, 48 of the retainer 44 fully engages the circumferential groove 22 in the barrel end 26 of the weapon, spring 56 pushes the stop 58 back through flange 38. Stop 58 then abuts the retainer 44 in the bottom of concave area 86 (FIGS. 5B and 1B), to prevent the retainer 44 from disengaging from the circumferential groove 22. Spring 56 is attached to housing 30 using, for example, rivets 62. FIGS. 3B and 3C show the openings 68 in flange 38 for the rivets 62 and the opening 70 in flange 38 for the stop 58. Further details of the housing 30 are shown in FIGS. 3A-3D.

Figure 4B:
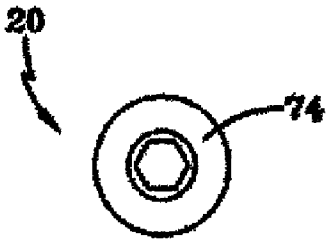
FIG. 4B is a top view of FIG. 4A.
Figure 4C:
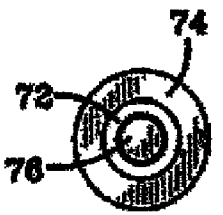
FIG. 4C is a bottom view of FIG. 4A.
Figure 4A:
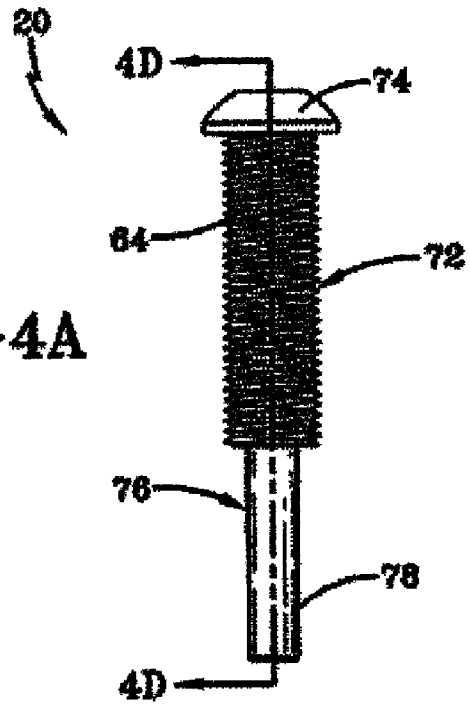
FIG. 4A is a front view of a stem.
Figure 4D:
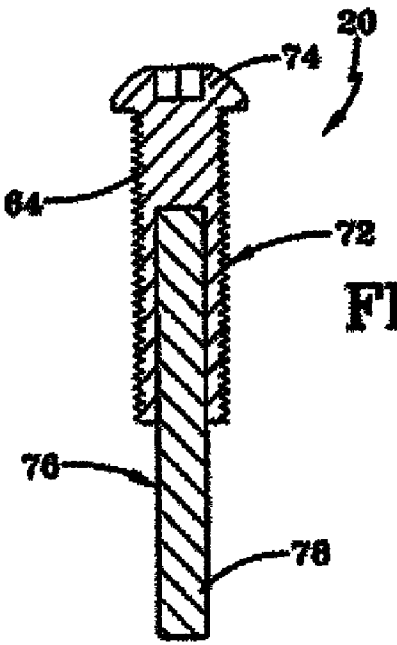
FIG. 4D is a sectional view taken along the line 4D-4D of FIG. 4A.

FIG. 4A is a front view of a stem 20. FIG. 4B is a top view of FIG. 4A. FIG. 4C is a bottom view of FIG. 4A. FIG. 4D is a sectional view taken along the line 4D-4D of FIG. 4A. Stem 20 comprises a threaded bolt 72 having a head 74 and a pin 76. Pin 76 is fixed in a bore in bolt 72. The lower portion 78 of the pin 76 is inserted in the barrel bore 16. Preferably, the pin 76 has a cylindrical body and circular cross-section. An important feature of the invention is the difference in cross-sectional area between the bore 16 and the pin 76 of stem 20. By inserting the pin 76 of the stem 20 in the bore 16, the cross-sectional area that is available for gas to escape the barrel 14 is greatly reduced. The stem 20 shown in the Figs. is made in two pieces so that only the pin portion 76 must be made from a material offering sufficient wear resistance to withstand the high temperature erosive environment that exists in the bore 16 when firing ammunition using the weapon 24.

If the BFA 10 is not used and a blank cartridge is fired in the weapon, the gas that is produced escapes out the end of barrel 14, leaving insufficient backpressure to cycle the weapon. With the BFA 10 installed, the lower portion 78 of pin 76 of the stem 20 is positioned inside the bore 16, as seen in FIGS. 1B and 1C. When a blank cartridge is fired, the decreased cross sectional area available for the gas to escape causes the gas pressure inside the bore 16 to increase, thereby providing sufficient backpressure to cycle the weapon. A sectional view of the gap between the stem 20 and barrel 14 is shown in the enlarged view of FIG. 1C.

The difference between the cross-sectional area of the bore 16 and the cross-sectional area of the stem 20 is an area small enough to generate sufficient backpressure in the bore 16 as to operate the weapon and large enough to bleed excess gas from the system as to prevent an overpressure condition in the bore 16. Therefore, the diameter of stem 20 (in particular, pin portion 76) will vary depending on the particular model of weapon 24, the diameter of the bore 16 of the model weapon 24, and the length of barrel 14 of the model weapon 24.

A BFA 10 for the U.S. Army's M249 Squad Automatic Weapon in the short barrel configuration has an optimum stem diameter (pin 76 diameter) of 0.198-0.002 inch. This optimized diameter assumes the end of the lower portion 78 of pin 76 of the stem 20 is positioned inside the bore 16 a distance of 0.125 inch to 0.225 inch as measured from the barrel crown 18.

Because the clearance area between the BFA stem 20 and barrel bore 16 is the limiting factor that regulates the mass flow of excess gas and resultant backpressure in the bore, a small change in this clearance area has the potential to significantly affect weapon powering. To maintain consistent weapon powering, the clearance area must be precisely controlled.

Manufacturing tolerances and material erosion of both the BFA stem 20 and barrel 14 influence the extent to which the designed clearance area will vary. Manufacturing tolerances are important because of the squared relationship between diameter and circular area. A small variation in diameter results in a larger variation in area. Therefore, in addition to tightly controlling the outer diameter tolerance of the BFA stem 20, the ideal interfacing feature is also precisely manufactured and dimensionally controlled using tight tolerances. Prior art BFAs use mating surfaces that are internally located in muzzle devices or in other parts, such as crush washers located between the muzzle device and barrel crown. In the present invention, the barrel bore itself is the interface for the BFA stem, because the barrel bore is fabricated using sufficiently tight dimensional tolerances.

Material erosion will also affect the variability in clearance area by increasing the diametric clearance between BFA stem and barrel bore as the total number of blank ammunition rounds fired using a given BFA and barrel increases. Inevitably the diametric clearance will increase and cause the level of generated backpressure to progressively lessen. To minimize this phenomenon, it is critical that the BFA stem, be manufactured of tungsten carbide, as discussed above and detailed below. Further, it is important, to maintain precise diametric clearance initially by controlling dimensional tolerances and is an additional reason to implement an interface within the barrel bore. Most of the barrels used in gas-operated rifles and small and medium caliber machine guns have chrome coated bores, which increases the wear resistance of the bore against material erosion. Similarly, the BFA stem material is important in that it must be able to sufficiently withstand such erosion.

The components of the BFA 10 may be fabricated through a series of machining, or casting with finish machining, and stamping operations. Heat treatment and surface coatings for components of the BFA are similar to those of the current practices associated with known blank firing attachments. Regarding the BFA stem 20 (i.e. pin 76), it is critical that the material of manufacture be tungsten carbide, preferably having a uniform microstructure, with a maximum grain size of less than 1 micron; a minimum tungsten carbide content of about 80%; a minimum cobalt content of about 10%, and a minimum hardness on the Rockwell A scale of about 91. As stated above, a more preferred tungsten carbide conforms to the International Organization for Standardizations (ISO) standard 513, K20 to K30 tungsten carbides, which require, tungsten carbide content of about 84 to about 90 mass %; cobalt content of 10 to about 16 mass %; a grain size of about 0.6 to about 0.8 microns (i.e. ultra fine to micro fine grade). Further, K20 to K30 tungsten carbide, has a Ra hardness of about 91.4 to about 91.8; transverse rupture strength of about 4 to about 4.3 GPa; fracture toughness of about 7.5 to about 8.7 MPa-$m^{1/2}$ and density of about 13.7 to about 14.5 g/$cm^3$.

As clearly disclosed within U.S. Pat. Nos. 2,731,711, entitled Sintered Tungsten Carbide Composition, issued Jan. 24, 1956 to Lucas; 3,165,822, entitled, Tungsten Carbide Tool Manufacture, issued Jan. 19, 1965 to Beeghly; 3,623,849, entitled, Sintered Refractory Articles of Manufacture, issued Nov. 30, 1971 to Benjamin; 4,684,405, entitled, Sintered Tungsten Carbide Material and Manufacturing Method, issued Aug. 4, 1987 to Kolaska; all incorporated herein by reference—the manufacture of carbide parts is old and well known in the art. Such manufacture is further detailed in the text, Metal Cutting Theory and Practice, $2^{nd}$ Ed., pages 146-8, by Stephenson and Agapiou, CRC Press (2006), which provides an example wherein tungsten carbide parts can be manufactured by mixing, compacting, and sintering tungsten-carbon, WC, and cobalt, Co, powders. The Co acts as a binder for the hard WC grains; the grain size and binder content largely determining the parts physical characteristics. This text states that such WC parts exhibit high transverse rupture strength, high compression strength, and high fatigue, good hot hardness, and that carbides conduct heat well. Further, the text states that, by varying the cobalt content, the relative balance of hardness and toughness can be changed.

Example

Data is presented in the following table, Table 1, from a series of test firings of an M249 Short Barrel Machine Gun, using BFAs of the style that is subject to this patent application, with stems of different materials, heat treatments, coatings, and stem tip geometry. The goal was to establish the number of blank rounds that can be fired prior to the particular BFA stem eroding, i.e. eroding to the point where the clearance between the BFA stem and barrel bore increased to cause the level of backpressure to lessen such that the weapon no longer automatically cycled (the life cycle of the particular stem).

TABLE 1

Life Cycle, In Blank Rounds Fired, Of Different Stem Materials

| Stem Material | Heat Treated to Rockwell C Scale Hardness | Coating (if any) | Coating Thickness (inches) | Stem End Geometry | Number of Blank Rounds to Failure |
|---|---|---|---|---|---|
| 4340 steel | Rc 28-32 | None | N/A | Flat End with 45 degree edge bevel | 200 |
| 4340 steel | Rc 28-32 | Hard chrome | .0002-.0004 | Flat End with 45 degree edge bevel | 200 |
| 4340 steel | Re 28-32 | Hard chrome | .001 | Flat End with 45 degree edge bevel | 600 |
| 4340 steel | Re 50+ | Plasmadize 3121 | .002 | Flat End with 45 degree edge bevel | 200 |
| 4340 steel | Re 50+ | Plasmadize 3131 | .002 | Flat End with 45 degree edge bevel | 200 |
| 4340 steel | Rc 50+ | Plasmadize 3171 | .002 | Flat End with 45 degree edge bevel | 200 |
| A2 tool steel | Rc 40-50 | Hard chrome | .001 | Rounded End | 200 |
| A2 tool steel | Re 40-50 | Titanium nitrate | .001 | Rounded End | 200 |
| H13 steel | Rc 50+ | Hard chrome | .001 | Rounded End | 400 |
| H13 steel | Rc 50+ | Hard chrome | .002 | Rounded End | 800 |
| H13 steel | Rc 50+ | Hard chrome | .005 | Rounded End | 200 |
| Tungsten Carbide | Ra 92 (Note 2) | None | N/A | Flat End with 45 degree edge bevel | Over 10,000 |

Notes:
1. For the purposes of this test, the firing schedule of the M249 machine gun was accelerated to one continuous 200 burst automatic fired rounds of the blanks, at the rate of 700 to 850 rounds per minute.
2. The tungsten carbide's hardness was measured in the Rockwell A scale - all other hardnesses presented are on the Rockwell C scale.

From Table 1, it can clearly be seen that a tungsten carbide BFA stem provides over 1150% greater life than the next best stem material—H13, heat treated, hard chrome coated steel—which is much more expensive that the commercially available tungsten carbide. Interestingly, stems manufactured of alternative, applicable steels; heat treated to increase hardness; with alternative applicable coatings, to further increase wear resistance and high temperature durability; and an alternative end geometry to improve the flow characteristics of the exiting propellant gases; all failed to extend the BFA stems operating life significantly, if at all.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A blank firing attachment for a gas-operated weapon having a barrel, the barrel having a bore with a cross-sectional area, the blank firing attachment comprising:

a housing having first and second ends;

a stem supported at the first end of the housing and extending along a longitudinal axis of the housing, the stem for insertion into the bore of the barrel, the stem having a cross-sectional area less than the cross-sectional area of the bore;

said stem being manufactured of tungsten carbide having a uniform microstructure, with a maximum grain size of less than 1 micron, a minimum tungsten carbide content of about 80%; a minimum cobalt content of about 10%; and a minimum hardness on the Rockwell A scale of 91; and means for attaching the housing to said barrel;

wherein, upon firing a blank cartridge in the weapon, a difference between the cross-sectional area of the bore and the cross-sectional area of the stem is an area small enough to generate sufficient backpressure in the bore as to operate the weapon and large enough to bleed excess gas from the system as to prevent an overpressure condition in the bore.

2. The blank firing attachment of claim 1, wherein said stem is manufactured of tungsten carbide that conforms to ISO standard 513, for K20 to K30 tungsten carbides, inclusive.

* * * * *